United States Patent [19]

Coggan et al.

[11] Patent Number: 4,969,302

[45] Date of Patent: Nov. 13, 1990

[54] SIDING PANELS

[75] Inventors: William G. Coggan, Rochester; Bertram C. Culpepper, Jr., Trenton; James A. Pozzo, Troy; Michael J. Sommer, Rochester; Richard C. Wilson, W. Bloomfield, all of Mich.

[73] Assignee: Abitibi-Price Corporation, Troy, Mich.

[21] Appl. No.: 691,667

[22] Filed: Jan. 15, 1985

[51] Int. Cl.[5] ..... E04C 2/00

[52] U.S. Cl. ..... 52/309.8; 52/540; 52/535

[58] Field of Search ..... 52/519, 535, 540, 520, 52/309.8, 518, 540

[56] References Cited

U.S. PATENT DOCUMENTS

| | | | |
|---|---|---|---|
| 2,075,676 | 3/1937 | Toney | 52/518 |
| 2,390,087 | 12/1945 | Fink | 52/518 |
| 2,418,758 | 4/1947 | Cooper | 52/540 |
| 2,727,283 | 12/1955 | Gollner | 52/535 |
| 3,290,845 | 12/1966 | Snyder | 52/519 |
| 3,875,715 | 4/1975 | Martin et al. | 52/309.8 |
| 4,493,175 | 1/1985 | Coppola, Jr. | 52/540 |

FOREIGN PATENT DOCUMENTS

| | | | |
|---|---|---|---|
| 6702163 | 8/1968 | Netherlands | 52/519 |
| 609361 | 9/1948 | United Kingdom | 52/540 |

*Primary Examiner*—David A. Scherbel
*Assistant Examiner*—Caroline D. Dennison
*Attorney, Agent, or Firm*—Barnes, Kisselle, Raisch, Choate, Whittemore & Hulbert

[57] ABSTRACT

A siding panel with a cover sheet of hardboard fixed by an adhesive to an underlying backerboard of resin foam. Preferably the panels are installed with their longitudes extending horizontally. Each panel is secured to a wall frame by nails passing through spaced apart holes through the cover sheet adjacent its upper longitudinal edge and a locking structure adjacent the lower longitudinal edge of the panel. In the first course of panels the locking structure engages a starter strip nailed to the wall frame and in each succeeding course of panels engages the upper edge of an adjacent panel in the immediately preceding course. The locking structure is a tongue and preferably an adjacent recess in the lower longitudinal edge of the backerboard which when installed receives and interlocks with the upper nailed edge of the cover sheet of an immediately adjacent panel or a flange of a starter strip simulating an upper edge of a panel.

33 Claims, 2 Drawing Sheets

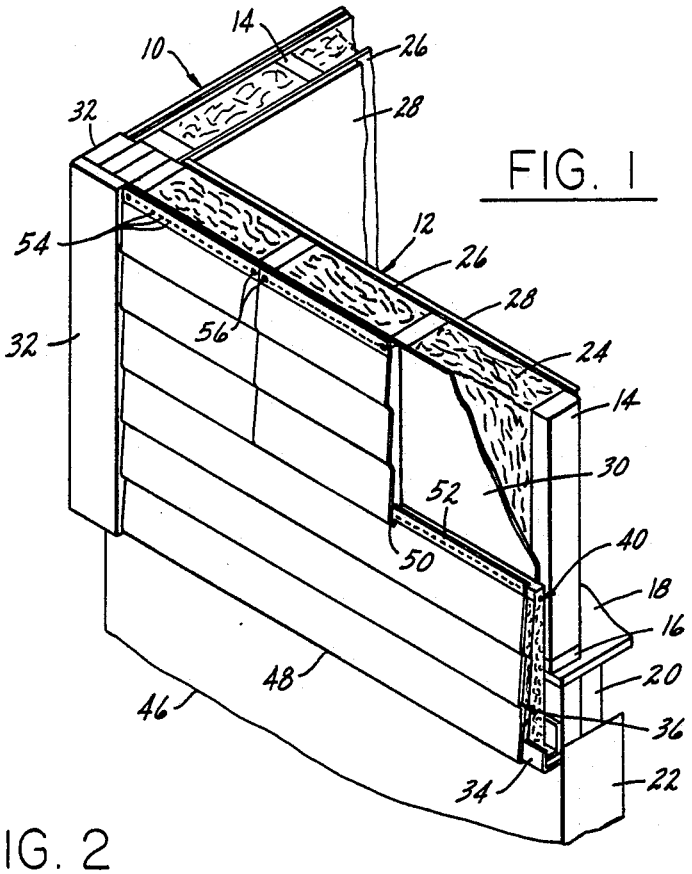
FIG. 1
FIG. 2
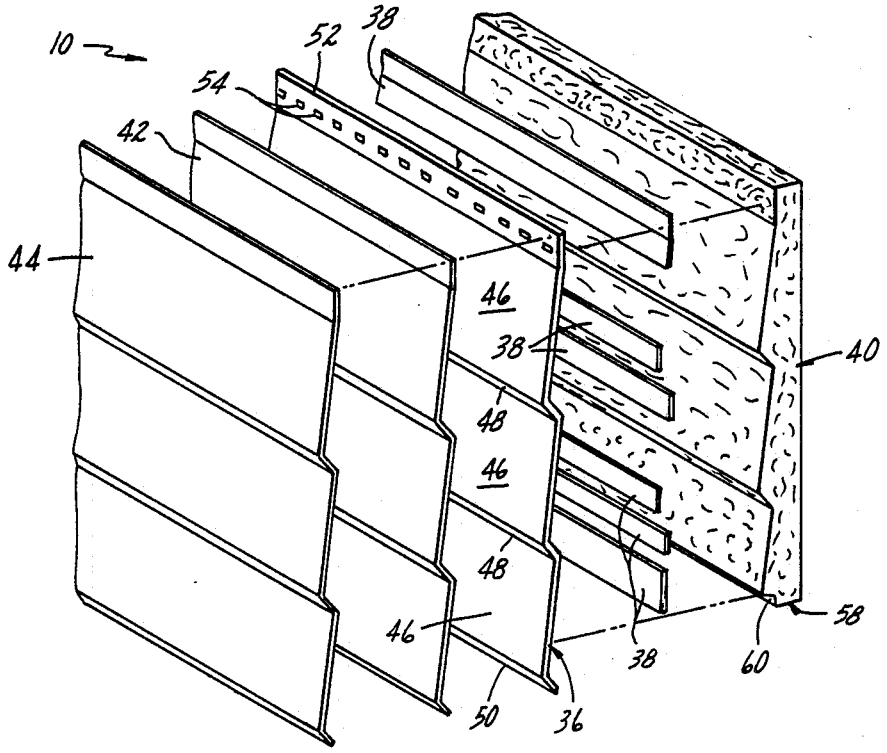

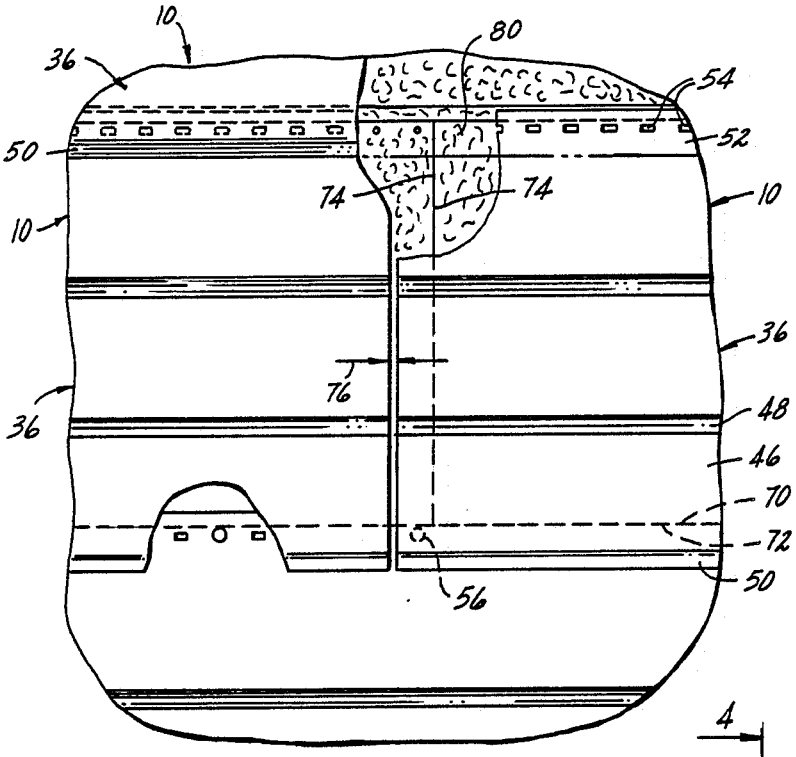
FIG. 4
FIG. 3
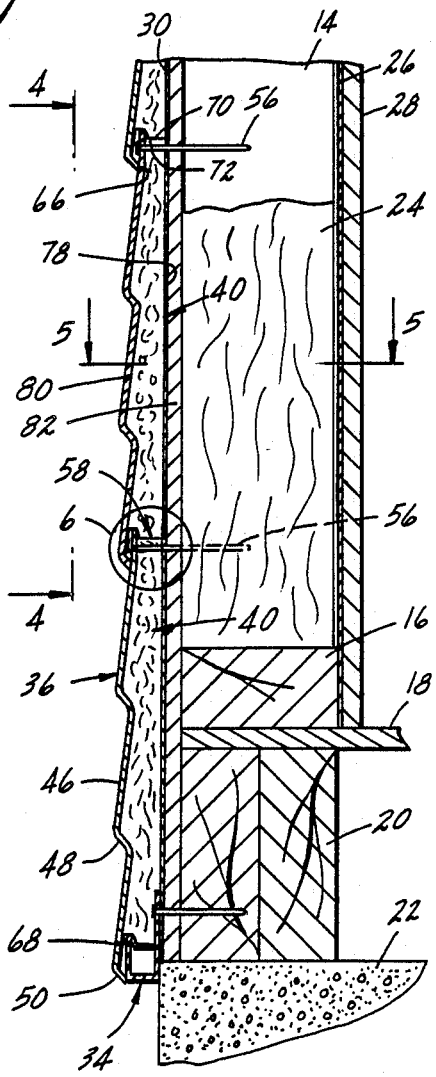
FIG. 5
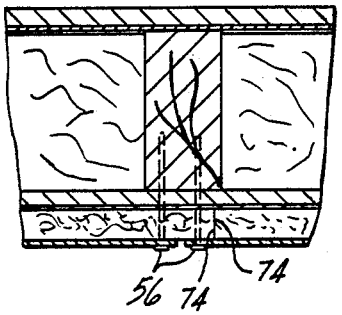
FIG. 6
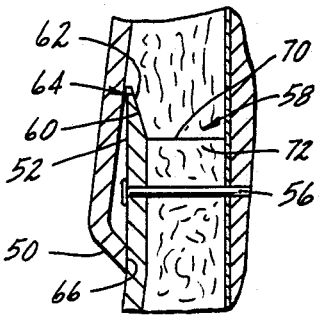

SIDING PANELS

FIELD

This invention relates to construction materials for buildings and more particularly to siding panels for buildings.

BACKGROUND

Various types of building siding panels of materials such as aluminum, steel and vinyl, have been previously used. Typically, horizontally extending long pieces of siding are fastened in overalpping relationship to wall framing of a building. Frequently, a backerboard of an insulating material, such as a resin foam, underlies the siding panel. Sometimes the backerboard is secured to the siding panel before the panel is installed on the building, although frequently it is inserted as a loose piece behind the siding panel when it is installed. Typically, there is a gap between adjacent pieces of backerboard which makes the insulation discontinuous. The panels are secured to the building in various ways such as by nails with exposed heads or by various specialized fasteners and fastener strips which are secured to the building prior to installing the panels on the strips.

SUMMARY

A building siding panel of this invention has a backerboard, preferably of an insulating material such as a firm resin foam, secured to a cover sheet, preferably of hardboard. A panel is secured to a building in installed relation by nails passing through spaced apart holes adjacent the upper longitudinal edge of the panel and a locking structure along the lower longitudinal edge of the panel. In the first course the locking structure engages a starter strip and in the succeeding courses it engages the upper edge of an adjacent panel in the immediately preceding course. Preferably, the locking structure comprises a tongue and an adjacent recess in the lower longitudinal edge of the backerboard which when installed receives and interlocks with the upper nailed edge of an immediately adjacent panel or a flange of a starter strip. To cover the nails, preferably the lower edge of one cover sheet overlaps the nailed upper edge of an immediately adjacent panel sufficiently to cover, protect and hide the nails from view.

Preferably, to provide weather-tight joints and an essentially continuous layer of insulating material, in assembly the edges of adjacent backerboards abut each other and along the line of abutment are overlapped by a portion of a cover sheet. Preferably, to provide a weather-tight seal around each nail securing a panel to a wall, its backerboard extends across and underlies each nail receiving hole through its cover sheet. Preferably, to provide the desired clearance for expansion between abutting ends of the cover sheets of a pair of adjacent panels, the longitudinal length of the backerboard of each panel is slightly greater than the longitudinal length of its associated cover sheet. Preferably, to prevent deterioration of the resin foam backerboard, the front face and the exposed portions of the back face of each cover sheet are sealed, primed and, if desired, pre-finished with suitable resins or paints which are dried at an elevated temperature before the backerboard is secured to its associated cover sheet.

Objects, features and advantages of this invention are to provide a hardboard siding panel which saves substantial material and labor costs in constructing walls, eliminates special fasteners and installation strips, covers, hides and seals installation nails, simulates lapped siding, provides one step application of both siding and insulating sheathing, has weather-tight joints, eliminates the need for separate structural sheathing, accurately controls the spacing between the cover sheets of the adjacent ends of abutting panels, can be pre-primed and pre-finished, provides a uniform lapped appearance by accurately controlling the vertical spacing between adjacent panels, is easily and economically manufactured, packaged and installed, is strong, rugged, durable and essentially maintenance free and has a long useful life in service.

These and other objects, features and advantages of this invention will be apparent from the following detailed description, appended claims and accompanying drawings in which:

FIG. 1 is a fragmentary perspective view with portions broken away of siding panels embodying this invention installed on an exterior frame wall of a building;

FIG. 2 is a fragmentary exploded view of a siding panel embodying this invention;

FIG. 3 is a fragmentary sectional view with portions broken away of siding panels embodying this invention installed on an exterior frame wall of a building that has sheathing underlying the siding;

FIG. 4 is a fragmentary side view with portions broken away taken generally on line 4—4 of FIG. 3 and illustrating a joint between the ends of adjacent siding panels;

FIG. 5 is a fragmentary sectional view taken generally on line 5—5 of FIG. 3 and illustrating the securing of ends of adjacent siding panels to a stud of the frame wall; and FIG. 6 is an enlarged fragmentary sectional view of the circled portion 6 of FIG. 3 illustrating details of the interlocking longitudinal edges of a pair of adjacent siding panels.

DETAILED DESCRIPTION

Referring in more detail to the drawings, FIG. 1 illustrates siding panels 10 embodying this invention installed on frame walls 12 of a building. Each frame wall has a plurality of spaced apart studs 14 secured by nails to a base plate 16 nailed to a sub-floor 18 supported by headers 20 received on a foundation wall 22. Thermal insulation 24 is installed between the studs. A vapor barrier 26 and dry wall 28 or plaster are secured to the interior of the wall.

Preferably, a weather-resistant barrier 30, such as building paper, tar paper or felt, is applied to the outer face of the studs. To cover or trim the ends of the siding panels at the corner of the walls, vertical trim boards or battens 32 are secured to the studs. To facilitate installing the siding and to secure the lower edge of the bottom course of siding to the wall, a starter strip 34 is nailed to the outer face of the header adjacent its bottom.

As shown in FIG. 2, each siding panel 10 has a cover sheet 36 preferably of hardboard secured preferably by strips of adhesive 38 to a backerboard 40 preferably of an insulating material, such as a resin foam. Preferably, but not necessarily, one or more coats of a sealer or primer 42 and/or of a pigmented finish coat 44 are applied to the outer face 46 of the cover sheet. Preferably, to seal, toughen and improve the appearance of the longitudinal edges and the exposed areas of the back face of the cover sheet which are not covered by the backerboard 40 the primer and/or finish coat are also applied to these edges and areas.

In accordance with a feature of the invention, preferably the cover sheet simulates lap siding with longitudinally extending generally flat and inclined wall portions 46 interconnected by longitudinally extending offset or step portions 48. Each cover sheet terminates in a bevelled or inclined lower longitudinal edge portion 50 and an upper longitudinal edge portion 52 which is preferably flat and inclined to the adjacent wall portion 46. Preferably, the cover sheet is of essentially the same or uniform thickness throughout.

Preferably, to facilitate nailing the siding panel, a plurality of spaced apart through holes 54 are formed in the upper edge 52 of the cover sheet. Preferably, to permit expansion and contraction of the cover sheet when the panel is installed, the holes 54 are elongated longitudinally. To permit this expansion and contraction and enable the panel to be installed with nails having heads of relatively small diameter, preferably the holes are generally rectangular.

In accordance with another feature of this invention, as shown in FIGS. 1 and 3, the upper edge of each siding panel is secured to a building by nails 56 and the lower edge is secured by interlocking engagement with either an adjacent siding panel or the starter strip 34. Each nail 56 is inserted through one of the holes 54 in the upper edge of the cover sheet and driven into a stud 14. The lower edge is interlocked by a longitudinally extending tongue 58 of its backerboard being received by an adjacent panel or the starter strip. As shown in FIG. 6, when interlocked with an adjacent panel, the tongue 58 is received behind and bears on the upper edge 52 of the cover sheet of the panel. To facilitate insertion, the tongue and upper edge are tapered with complementary inclined faces 60 and 62 which preferably abut to also provide a weather-tight seal. Preferably, to interlock adjacent panels between the studs, the tip of the upper edge is received in a recess 64 in the backerboard and the end face 66 of the lower edge bears on the outer face of an adjacent panel. Preferably, tongue 58 recess 64 and end face 66 of the cover sheet are dimensioned, constructed and arranged so that when installed the end face 66 is urged into sealing engagement with the underlying cover sheet of an adjacent panel and the abutting faces 60 and 62 are urged together. This is facilitated by the slight resiliency of the resin foam backerboard. As shown in FIG. 3, when interlocked with the starter strip 34, the tongue 58 is received behind a flange 68 with a contour which simulates the upper edge of a panel.

In accordance with another feature of the invention, the lower edge of the cover sheet 36 of each panel overlaps the upper edge 52 of an underlying cover sheet of an adjacent panel sufficiently to cover, protect from the weather and shield from view the fastening nails 56 and the holes 54 in the upper edge. This improves the appearance of the installed siding panels and virtually eliminates corrosion of the nails and discoloration and staining of the siding by the corrosion products.

Preferably, in accordance with another feature of this invention, when installed, weather-tight joints are formed between the siding panels. As shown in FIGS. 3 and 6, the backerboards 40 have mating upper and lower longitudinal edges 70 and 72 which abut each other and are overlapped by a portion of their associated cover sheets 36. This overlapping construction is achieved by making the width or vertical height of each backerboard less than the corresponding width or vertical height of its associated cover sheet. By abutting the longitudinal edges 70 and 72 of the backerboards, when installed, an essentially continuous layer of underlying insulating material is provided. These abutting edges also accurately control and pre-determine the vertical spacing between the lower edges 50 of the cover sheets of adjacent panels so that when installed all of the siding portions 46 appear to be uniform or of the same width or vertical height.

When installed, preferably a weather-tight joint is also formed between the ends of adjacent siding panels. As shown in FIGS. 4 and 5, the adjacent ends 74 of adjacent backerboards abut each other and are overlapped by an end portion of a cover sheet 36 associated with one of the backerboards. This is achieved by making the longitudinal length of the backerboard at least as long as the longitudinal length of its associated cover sheet and longitudinally offsetting the backerboard and cover sheet so that at one end the backerboard projects beyond one end of its associated cover sheet and at the other end terminates longitudinally inward of the other end of its associated cover sheet.

In accordance with a further feature of this invention, when installed, preferably the siding panels provide a slight predetermined clearance 76 between adjacent ends of the cover sheets 36 of the abutting ends of adjacent siding panels. This clearance 76 permits the hardboard cover sheets to expand and contract without buckling in response to changes in their moisture content, temperature and other weather conditions. Preferably, this predetermined clearance is provided by making the longitudinal length of the backerboard 40 of each panel slightly longer than the longitudinal length of its associated cover sheet 36 by an amount equal to the desired nominal clearance 76. Typically, this clearance is about 1/16" to 3/32". Of course, this clearance can almost be provided when installing this siding by manually positioning the siding panels to provide this slight gap. Preferably, in accordance with another feature of the invention, to provide a weather-tight seal around the shank of each nail 56, the backerboard underlies and extends generally transversely across each hole 54 in its associated cover sheet. When each nail is inserted through the hole 54 and pierces the backerboard, the backerboard firmly engages its shank to provide a seal, as shown in FIGS. 5 and 6.

To facilitate installing the siding panels, preferably the backerboard has an essentially flat back or inner face 78. Preferably, to support the cover sheet essentially throughout, and to facilitate assembly, the front face 80 of the backerboard has a contour complementary to and conforming with the overlying portion of the back face of the cover sheet. Preferably, the backerboard is a firm resin foam having a density of not more than about 5 lbs/Ft$^3$, usually 1/2 to 3 lbs/Ft$^3$ and preferably about 1 lb/Ft$^3$. Preferably, the backerboard is a firm plastic foam of a resin such as polystyrene, polyurethane, or the like. A firm backerboard of expanded polystyrene having a density of about 1 lb/Ft$^3$ is believed to be highly satisfactory. The nominal thickness of the backerboard can be varied to provide the desired amount of thermal insulation. Typically, the backerboard has a nominal thickness of about ½" to 3", and preferably about ¾" to 1". The contour of the front face 80 of a resin foam backerboard can be formed by grinding, wire slicing, cutting, and the like.

In accordance with another feature of this invention, siding panels with hardboard sheets with a nominal thickness of ⅛" have sufficient strength and rigidity that they can be used to construct exterior walls complying with building codes when installed directly on conventional framing with 2"×4" studs on 16" centers without separate sheathing as shown in FIG. 1. This provides a one-step application of exterior siding and insulating material which eliminates the material and labor cost for applying separate sheathing to the exterior of the wall. When no separate sheathing is used, metal straps or other bracing should be used on the corners and gable ends of the framing on which the siding panels are installed. Of course, as shown in FIG. 3, the siding panels can also be applied over conventional sheathing 82, such as wood planks, plywood, building board, such as Celotex, and the like secured to the framing before the siding panels are installed.

MAKING THE PANELS

Preferably, although not necessarily, the cover sheet 36 is molded hardboard of wood or lignocellulose fibers with three wall portions 46 and a nominal width of 12 inches, length of 16 feet, thickness of ⅛ inch, and density usually in the range of about 35 to 75 lbs/Ft$^{3'}$ desirably 40 to 65 lbs/Ft$^3$, and preferably 45 to 60 lbs/Ft$^3$. Preferably, four cover sheets 36 are molded simultaneously in a press and subsequently separated. They can be molded with a smooth, textured or grained surface on the front face, utilizing a mold having top and bottom caul plates each contoured to form the desired shape (shown in FIG. 2) of the cover sheets. Usually, a wire screen, preferably of stainless steel, is used to carry into the mold a mat of wood fibers to be molded and to form a textured surface of the back face of the cover sheets.

To toughen and harden the front face of the hardboard cover sheets, preferably a liquid coat of a thermosetting and/or oxidizable resin is applied to the fiber mat before molding and is at least partially cured in the press during molding of the cover sheet. Preferably, but not necessarily, to improve the appearance and durability of the outer face of the finished siding panel, a paper overlay may be used when molding the cover sheet. The paper overlay is inserted between the top surface of the mat forming the cover sheet and the hot top platen or caul plate before the press is closed to mold the cover sheet. Suitable paper overlays can be made of newsprint. Preferably, the molded hardboard cover sheets are made by the method disclosed in U.S. Pat. No. 4,038,131. Since various methods of making satisfactory hardboard cover sheets are well-known to persons, they will not be described herein in further detail.

To further toughen and harden the molded hardboard cover sheets, after molding they are baked at an elevated temperature of about 250° F. to 320° F. for about two to four hours. To minimize warping and stabilize the dimensions of the baked cover sheets, their moisture content is raised to a suitable level, which is typically in the range of about 2% to 8% and usually about 3% to 4% by weight. Usually, the moisture content of the cover sheets is raised by passing them through a humidifier.

After humidification, the periphery of each cover sheet is trimmed or sized to provide the desired size of the finished cover sheet. Preferably, the face 62 is also cut along the upper longitudinal edge 52 to form the tapered tip (FIG. 6) of the edge and the end of the lower bevel edge 50 is cut to form the flat sealing face 66. Preferably, the holes 54 are formed in each cover sheet by a rotary punch. To facilitate securing the ends of each siding panel to a stud of a wall, preferably a hole 54 is formed in each cover sheet within ¾" of each end and preferably within about 3/16" to ⅜" of each end.

To facilitate painting or finishing the siding panels at the job site, preferably, but not necessarily, a primer is applied to at least the outer face of the cover sheet. Preferably, the primer is also applied along the longitudinal edges and to the portions of the back face of the cover sheet which will not be covered by the backerboard. Preferably, the primer is tinted to a light gray color so that it will be satisfactory for use with finish coats of paint of a wide range of colors applied after the siding panels are installed. Suitable primers are alkyd, acrylic, melamine, latex or similar thermoplastic or thermosetting resins, which can be either water or solvent based. A suitable water base thermoset acrylic-latex primer is commercially available from Valspar Corporation of 1101 Third Street South, Minneapolis, Minn. 55415, as Product No. 8LK2516. The acrylic resin of this primer is available from Rohm and Hass, Independence Mall West, Philadelphia, Pa. 19105 as acrylic resin AC 1822.

Preferably, two coats of primer are applied to the cover sheets. The liquid primer can be applied to the cover sheet by spraying, rolling, curtain coating and the like. Preferably, the first coat of primer is applied by using a Paint-O-Matic applicator sold by Paint-O-Matic, P.O. Box 1426 of Willits, Calif. 95490. This applicator pours a pool of liquid primer on the cover sheet and uses an air stream produced by a partial vacuum to remove excess primer and leave a thin and uniform coat on the cover sheet. Preferably, the first coat of primer has a wet film nominal thickness of about 1 mil and a dry film nominal thickness of about 0.5 mil.

The first coat of liquid primer is dried and cured by raising it to an elevated temperature of about 200° F. to 400° F. and preferably about 325° F. to 375° F. Preferably, the liquid primer is cured and dried by both infrared heating to accelerate cross linking of the resins and forced hot air heating to remove moisture and any solvents. Preferably, the liquid primer on the cover sheet passes through an infrared oven for five to fifteen seconds to raise the temperature of the film of primer to at least about 240° F. Preferably, the liquid primer is then dried in a high velocity hot air oven for about ten to sixty seconds, usually about twenty to forty seconds, and preferably about twenty-five to thirty-five seconds operating with the forced air at a temperature of about 300° F. to 550° F. and preferably about 450° F. to 550° F.

Preferably, the second coat of primer is applied by using a conventional curtain coater. Preferably, the second coat has a wet film nominal thickness of about 1.6 mil and a dry film nominal thickness of about 0.8 mil.

The wet second coat of primer is dried and cured by raising it to an elevated temperature of about 200° F. to 400° F. and preferably about 325° F. to 375° F. Preferably, the second coat of primer is cured and dried by both infrared heating to accelerate cross linking of the resins and forced hot air to remove the vehicle of water and any solvents. Preferably, the second coat on the cover sheet passes through an infrared oven for about ten to twenty seconds to raise the temperature of the second coat to at least about 240° F. Preferably, the second coat is then dried in a high velocity hot air oven for about ten to sixty seconds, usually about twenty to forty seconds and preferably about twenty-five to thirty-five seconds operating with the forced air at a temperature of about 300° F. to 550° F. and preferably about 450° F. to 550° F.

When the cover sheets are to be pre-finished, one or more finish coats of a suitable resin or paint tinted to a pre-determined desired color are applied to the cover sheet. Preferably, to toughen, seal and improve the appearance of the longitudinal edges and the exposed areas of the back face of the cover sheet, the finish coat is also applied to these edges and areas. Suitable finish coating materials are acrylic, latex, alkyd, melamine, lacquer and like thermosetting and thermoplastic resins. Acrylic, latex and like resins which form a dry film which breathes to permit moisture to pass through the film are preferred because they decrease the likelihood of blistering of the finish coat when the siding is in use. A suitable thermoset water base acrylic latex resin coating with a white color is commercially available from Valspar Corporation of 1101 Third Street South, Minneapolis, Minn. 55415 as Product No. BL 91304.

The liquid finish coat can be applied to the cover sheet by spraying, rolling, curtain coating, and the like. Preferably, to toughen, seal and improve the appearance of the longitudinal edges and the exposed areas of the back face of the cover sheet, the finish coat is also applied to these edges and areas. Preferably, two finish coats are applied to the cover sheet in the same manner as the primer. The first coat is applied with a Paint-O-Matic applicator and the second coat is applied with a conventional curtain coater. Each coat is preferably cured and dried in infrared and forced hot air ovens. Preferably, the first finish coat has a nominal film thickness of about 1.5 mils wet and about 0.7 mil dry. The second finish coat has a nominal film thickness of about 2 mils wet and 1 mil dry.

When the backerboard 40 is a resin foam, any primer and finish coats which must be heated to an elevated temperature to be dried and cured must be applied and cured on the cover sheet before the resin backerboard is secured to the cover sheet. This is necessary to prevent damage, distortion and deterioration of the backerboard since typically it will melt at a temperature of about 250° F. Preferably, the contour of the front face and the recess 66 of the backerboard are formed by grinding a rectangular block of resin foam. If a longitudinal edge 70 or 72 of the backerboard is formed by cutting the resin foam, its toughness, durability and appearance can be improved by applying a coat of a resin or paint which will dry and cure at room temperature such as a water base latex paint.

Preferably, the resin backerboard is secured to the cover sheet with a suitable adhesive. Suitable adhesives should have the properties of high strength of adhesion, low temperature cure, being chemically inert with respect to the hardboard and resin backerboard to prevent attack and deterioration thereof, good resistance to heat, aging, moisture, water, freezing and fungus growth. Suitable water base adhesives which have no strong solvents and cure at room temperature, are polyvinyl chloride, phenolic and resorcinal resin adhesives. A suitable two-component cross-linking vinyl polymer isocyanate adhesive, which produces highly satisfactory bonding, is commercially available from H. B. Fuller Company, Assembly Products Div., 5220 Main Street N.E., Minneapolis, Minn. 55421, as adhesive AP-3420 and catalyst AP-3440. This adhesive meets ASTM standards 2559 and D-3110. This adhesive can be applied to either the backerboard or the cover sheet by spraying at the rate of about 60 to 70 pounds of catalyzed adhesive per 1,000 square feet. Typically, this adhesive will cure at room temperature in about three to fifteen minutes and usually about five to ten minutes.

INSTALLING THE PANELS

Typically, the siding panels 10 are installed in new construction over the wall framing with or without sheathing, and in retrofitting of existing exterior walls directly over the old siding. As shown in FIGS. 1 and 3, a starter strip 34 is installed by nailing it to the wall along the lower edge of the wall. The first course of siding panels is then installed by inserting the lower edge of each panel into the starter strip so that it interlocks with the starter strip to retain the lower edge on the wall. The upper edge of each panel is then secured to the wall by inserting nails 56 through selected ones of the holes 54 along the upper edge of the panel and driving the nails into the studs. The nail heads are seated firmly to the outer face of the cover sheet of the siding panels, but are not overdriven to distort the siding. If needed, shims may be used to avoid drawing the siding against uneven walls. Preferably, aluminum or other corrosion resistant nails are used with a head of sufficient diameter so that they will not pull through the holes 54 in the cover sheet.

After the first course is installed, each succeeding course of siding panels is installed by interlocking the lower edge of a panel with the upper edge of the panel of the preceding course which is already secured to the wall, and then nailing the upper edge of the panel to the wall. When installed, the lower edge of each panel is firmly retained in position by interlocking engagement of the tongue portion 58 of its backerboard 40 with the immediately adjacent upper longitudinal edge 52 of the siding panel of the immediately preceding course which is already secured to the wall.

We claim:

1. A building siding panel comprising an elongate cover sheet having a pair of spaced apart, integral and generally longitudinally extending edges, a separate and firm backerboard of a resin foam insulating material underlying one side of said cover sheet and being fixed to said cover sheet, said backerboard having a pair of spaced apart, integral and generally longitudinally extending edges disposed between and adjacent and constructed and arranged such that they are spaced inward transversely of said longitudinally extending edges of said cover sheet, one of said longitudinal edges of said cover sheet being a substantially straight edge extending longitudinally substantially throughout the length of said cover sheet, projecting outwardly transversely beyond the adjacent longitudinal edge of said backerboard and constructed and arranged such that when assembled with another immediately adjacent first panel said straight edge underlies and is overlapped by the cover sheet of such adjacent first panel, an integral tongue of said backerboard extending longitudinally substantially throughout the length of said cover sheet, spaced inward transversely of and adjacent the other longitudinal edge of said cover sheet and constructed and arranged such that when assembled with another immediately adjacent second panel said tongue underlies and is overlapped by the straight edge of the cover sheet of such adjacent second panel to interlock said siding panel with such second panel, a plurality of longitudinally spaced apart holes through said cover sheet immediately adjacent said one straight edge thereof, overlying said backerboard and constructed and arranged when assembled to underlie and be overlapped and covered up by such cover sheet of such adjacent first panel.

2. The siding panel of claim which also comprises a recess in said backerboard adjacent said cover sheet and said tongue and extending longitudinally substantially throughout the length of said backerboard and constructed and arranged when assembled with such second panel to slidably receive by edgewise insertion the straight edge of the cover sheet of such adjacent second panel with the straight edge of such adjacent second panel bearing on said backerboard of said siding panel and said other longitudinal edge of said cover sheet of said siding panel bearing on the cover sheet of such second panel, whereby a substantially weathertight seal is obtained between said siding panel and such second panel.

3. The siding panel of claim 1 wherein said backerboard comprises a firm foam of resin and having a density not greater than about five pounds per cubic foot.

4. The siding panel of claim 1 wherein said cover sheet comprises hardboard having a density of about 40 to 75 pounds per cubic foot.

5. The siding panel of claim 1 wherein said cover sheet comprises hardboard having a density of about 40 to 75 pounds per cubic foot, and said backerboard comprises a firm foam of resin and having a density not greater than about 5 pounds per cubic foot.

6. The siding panel of claim 5 which also comprises a recess in said backerboard adjacent said cover sheet and said tongue and extending longitudinally substantially throughout the length of said backerboard and with the straight edge of such adjacent second panel bearing on said backerboard of said siding panel and said other longitudinal edge of said cover sheet of said siding panel bearing on the cover sheet of such second panel, whereby a substantially weathertight seal is obtained between said siding panel and such second panel.

7. The siding panel of claim 1 wherein said resin foam of said firm backerboard is somewhat resilient and said backerboard underlies said holes through said cover sheet, extends generally transversely across and beyond said holes, and terminates in one of said longitudinal edges of said backerboard which underlies and does not project beyond said straight edge of said cover sheet, whereby said backerboard provides a substantially weathertight seal for said holes and when in assembly any fasteners passing through said holes and said backerboard.

8. The siding panel of claim 1 wherein said backerboard comprises a firm resin foam and each of said longitudinally extending edges of said backerboard extends generally longitudinally of said cover sheet and is constructed and arranged such that when assembled with its adjacent one of such first and second panels, bears on and abuts with a complimentary face of the adjacent longitudinal edge of the backerboard of such adjacent panel, whereby in assembly the backerboards provide a substantially continuous layer of insulating material underlying the cover sheets thereof.

9. The siding panel of claim 8 wherein said cover sheet has a pair of generally opposed ends extending generally transversely of the longitude thereof, said backerboard has a pair of generally opposed ends extending generally transversely of the longitude thereof, one end of said backerboard projects longitudinally beyond an adjacent one end of said cover sheet and the other end of said cover sheet lies adjacent to and projects longitudinally beyond the other end of said backerboard.

10. The siding panel of claim 1 wherein the perimeter of said cover sheet is generally rectangular and has a pair of longitudinally spaced apart ends each of which extends generally transverse to said longitudinal edges of said cover sheet, said backerboard has a generally rectangular perimeter and a pair of longitudinally spaced apart ends each of which extends generally transverse to said longitudinal edges of said backerboard, one of said ends of said backerboard is longitudinally spaced from and projects beyond the adjacent one end of said cover sheet and the other end of said cover sheet is longitudinally spaced from and projects beyond the adjacent other end of said backerboard, such that when said siding panel is installed in end-to-end relationship with another panel the projecting end portion of said backerboard of said siding panel underlies and is overlapped by the projecting end portion of the cover sheet of such another panel and the joint between the adjacent ends of the cover sheets of said siding panel and another panel is longitudinally spaced from the joint between the adjacent ends of the backerboards of said siding panel and another panel.

11. The siding panel of claim 10 wherein said cover sheet and backerboard are constructed and arranged such that when initially assembled in end-to-end relationship with such another panel the adjacent ends of the backerboards of said siding panel and another panel abut each other.

12. The siding panel of claim 10 wherein said cover sheet and backerboard of said siding panel are constructed and arranged such that when assembled in end-to-end relationship with such another panel the adjacent ends of the backerboard of said siding panel and another panel abut each other and there is normally a slight gap between the adjacent ends of the cover sheets of said siding panel and another panel, whereby said cover sheet can expand in response to changing weather conditions without buckling.

13. The siding panel of claim 12 wherein the longitudinal length of said backerboard of said siding panel from one end to the other is slightly greater than the longitudinal length of said cover sheet of said siding panel from one end to the other, such that when initially assembled with the adjacent ends of the backerboards of such siding panel and another panel abutting each other the gap between the adjacent ends of the cover sheets of such siding panel and another panel is substantially equal to the difference between the longitudinal length of said cover sheet and backerboard of said siding panel.

14. The siding panel of claim 5 wherein the exposed back face of said backerboard is generally flat.

15. The siding panel of claim 5 wherein the nominal thickness of said cover sheet of hardboard is substantially uniform.

16. The siding panel of claim 5 wherein said cover sheet has front and back faces and which also comprises a primer coat on the front face, the longitudinally extending edges, and at least the portions of the back face adjacent the longitudinal edges of said cover sheet of hardboard.

17. The siding panel of claim 5 which also comprises a coat of resin on at least a portion of said tongue of said backerboard.

18. The siding panel of claim 16 which also comprises such primer coat having been cured at an elevated temperature of at least 200° F prior to said backerboard being fixed to said cover sheet.

19. The siding panel of claim 5 which also comprises at least one finish coat on at least the front face of said cover sheet of hardboard with all of said coats being applied prior to securing said cover sheet to said backerboard, whereby the front face is prefinished prior to installation of the siding panel.

20. The siding panel of claim 19 which also comprises at least one of said coats having been cured at an elevated temperature of at least 200° F prior to said backerboard being fixed to said cover sheet.

21. The siding panel of claim 12 which also comprises said backerboard having a generally flat back face and each of said longitudinal edges having a generally flat face extending generally transversely to said back face and being constructed and arranged such that when in assembly adjacent generally flat surfaces of the longitudinal edges of adjacent backerboards of adjacent siding panels abut each other.

22. The siding panel of claim 1 wherein said straight edge of said cover sheet is a sharp edge having a tapered back face constructed and arranged to facilitate during assembly insertion of said straight edge into interlocking relationship with the tongue of such adjacent first panel.

23. The siding panel of claim 5 wherein said cover sheet has at least two longitudinally extending wall portions interconnected by a longitudinally extending step portion such that said cover sheet simulates at least two longitudinally extending pieces of lap siding.

24. The siding panel of claim 23 wherein said backerboard has a face complementary to and bearing on the back face of said cover sheet including the back face of the step portion of said cover sheet.

25. The siding panel of claim 24 wherein said wall portions and said step portion of said cover sheet are of substantially uniform nominal thickness.

26. The siding panel of claim 24 wherein the back face of said backerboard is generally flat.

27. The siding panel of claim 1 wherein said holes are elongate longitudinally.

28. The siding panel of claim 5 wherein the nominal thickness of said cover sheet is substantially uniform and at least about one eighth of an inch.

29. The siding panel of claim 21 wherein said flat faces of said longitudinal edges of said backerboard are generally parallel to each other and said straight edge of said cover sheet, and said flat edges are located with respect to said cover sheet such that when assembled with such first and second panels the transverse extent of the exposed portion of said cover sheet is uniform from one panel to another.

30. The siding panel of claim 12 wherein the longitudinal length of said backerboard is at least one sixteenth of an inch greater than the longitudinal length of said cover sheet.

31. The siding panel of claim 7 wherein said holes are elongate longitudinally of said cover sheet such that when assembled with fasteners through at least some of said holes and said backerboard said cover sheet can longitudinally expand and contract relative to such fasteners due to changes in temperature without buckling said cover sheet and without loosening such fasteners.

32. The siding panel of claim 3 wherein said tongue of said backerboard and said longitudinal edges of said cover sheet are dimensioned, constructed and arranged in relation to each other such that when said siding panel is assembled with such second panel its straight edge bears on both said other longitudinal edge of said cover sheet and said tongue of said backerboard of said siding panel and slightly compresses or flexes said tongue, whereby a substantially weathertight seal is provided between said siding panel and second panel substantially throughout the interlocked length thereof.

33. A building panel comprising an elongate cover sheet having a pair of spaced apart, integral and generally longitudinally extending edges, a firm backerboard of a resin foam insulating material underlying one side of said cover sheet and being fixed to said cover sheet, said backerboard having a pair of spaced apart, integral and generally longitudinally extending edges disposed between and adjacent and constructed and arranged such that they are spaced inward transversely of said longitudinally extending edges of said cover sheet, one of said longitudinal edges of said cover sheet being a substantially straight edge extending longitudinally of said cover sheet, projecting outwardly transversely beyond the adjacent longitudinal edge of said backerboard and constructed and arranged such that when assembled with another immediately adjacent first panel said straight edge underlies and is overlapped by the cover sheet of such adjacent first panel, an integral tongue of said backerboard extending longitudinally of said cover sheet, spaced inward transversely and adjacent the other longitudinal edge of said cover sheet and constructed and arranged such that when assembled with another immediately adjacent second panel said tongue underlies and is overlapped by the straight edge of the cover sheet of such adjacent second panel to interlock said siding panel with such second panel, a plurality of longitudinally spaced apart holes through said cover sheet immediately adjacent said straight edge thereof, underlying said backerboard, and constructed and arranged when assembled to underlie and be overlapped and covered up by such cover sheet of such adjacent first panel.

* * * * *

UNITED STATES PATENT AND TRADEMARK OFFICE

CERTIFICATE OF CORRECTION

PATENT NO. : 4,969,302

DATED : November 13, 1990

INVENTOR(S) : William G. Coggan, Bertram C. Culpepper, Jr., James A. Pozzo, Michael J. Sommer, Richard C. Wilson and Patrick M. Culpepper It is certified that error appears in the above—identified patent and that said Letters Patent is hereby corrected as shown below:

ON TITLE PAGE: Item [75]

PLEASE ADD THE NAME OF "PATRICK M. CULPEPPER" AS A JOINT INVENTOR.

Signed and Sealed this

Second Day of June, 1992

*Attest:*

DOUGLAS B. COMER

*Attesting Officer*

*Acting Commissioner of Patents and Trademarks*